US007437881B2

(12) United States Patent
Hirota

(10) Patent No.: US 7,437,881 B2
(45) Date of Patent: Oct. 21, 2008

(54) CONTROL VALVE FOR VARIABLE DISPLACEMENT COMPRESSOR

(75) Inventor: Hisatoshi Hirota, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 312 days.

(21) Appl. No.: 11/324,234

(22) Filed: Jan. 4, 2006

(65) Prior Publication Data

US 2006/0150649 A1 Jul. 13, 2006

(30) Foreign Application Priority Data

Jan. 12, 2005 (JP) ..... 2005-004871

(51) Int. Cl.
*F25B 19/00* (2006.01)

(52) U.S. Cl. ..... 62/228.3; 251/129.01; 251/321

(58) Field of Classification Search ..... 62/228.3; 417/222.2; 251/129.01, 129.02, 129.22, 251/227, 321
See application file for complete search history.

(56) References Cited

U.S. PATENT DOCUMENTS

2004/0202552 A1* 10/2004 Okii et al. ..... 417/222.2
2005/0098211 A1* 5/2005 Ichinose et al. ..... 137/82
2005/0211939 A1* 9/2005 Morisawa et al. ..... 251/129.15
2007/0012057 A1* 1/2007 Umemura et al. ..... 62/228.3

FOREIGN PATENT DOCUMENTS

JP 2003-328936 11/2003

* cited by examiner

*Primary Examiner*—Marc E Norman
(74) *Attorney, Agent, or Firm*—Westerman, Hattori, Daniels & Adrian, LLP.

(57) ABSTRACT

To provide a control valve for a variable displacement compressor, which is capable of stably operating in a pressure control area, and causing the compressor to quickly shift to operation with the minimum displacement. The control valve for a variable displacement compressor is capable of realizing stable pressure control, since a force applied to a valve element in a valve-closing direction increases when the valve element is in a pressure control area, and is balanced with a force applied to the valve element in a valve-opening direction by the pressure of refrigerant. Further, when the valve element moves past an end point of the pressure control area, the force applied to the valve element in the valve-closing direction decreases to thereby increase the valve-opening degree of a valve portion when the valve portion is fully open. Therefore, when a solenoid is not energized, it is possible to ensure a sufficient flow rate of refrigerant, thereby making it possible to cause the compressor to quickly shift to operation with the minimum displacement.

6 Claims, 2 Drawing Sheets

CONTROL VALVE FOR VARIABLE DISPLACEMENT COMPRESSOR

CROSS-REFERENCES TO RELATED APPLICATIONS, IF ANY

This application claims priority of Japanese Application No. 2005-004871 filed on Jan. 12, 2005 and entitled "CONTROL VALVE FOR VARIABLE DISPLACEMENT COMPRESSOR".

BACKGROUND OF THE INVENTION (1) Field of the Invention

The present invention relates to a control valve for a variable displacement compressor, and more particularly to a control valve for a variable displacement compressor, for controlling discharging amount of refrigerant in the compressor forming a component of a refrigeration cycle for an automotive air conditioner.

(2) Description of the Related Art

A compressor used in the refrigeration cycle of an automotive air conditioner, for compressing refrigerant, uses an engine as a drive source, and hence is incapable of performing rotational speed control. To eliminate the inconvenience, a variable displacement compressor capable of varying the displacement of refrigerant is employed so as to obtain an adequate cooling capacity without being constrained by the rotational speed of the engine.

In such a variable displacement compressor, a wobble plate fitted on a shaft driven by the engine for rotation has compression pistons connected thereto, and by varying the inclination angle of the wobble plate, the stroke of the pistons is varied to vary the discharge amount of refrigerant.

The inclination angle of the wobble plate is continuously changed by introducing part of compressed refrigerant into a hermetically closed crankcase to cause a change in the pressure of the introduced refrigerant, thereby changing the balance of pressures acting on the opposite sides of each piston.

A control valve is disposed between a discharge chamber and a crankcase of the compressor, or between the crankcase and a suction chamber of the compressor, for adjusting pressure in the crankcase by changing the flow rate of refrigerant introduced from the discharge chamber into the crankcase, or changing the flow rate of refrigerant delivered from the crankcase to the suction chamber. For example, in the former case, an orifice is disposed between the crankcase and the suction chamber, and a path is formed through which refrigerant is allowed to flow from the discharge chamber into the suction chamber. The control valve includes a valve element which is moved to and away from a valve hole forming a refrigerant passage communicating e.g. between the discharge chamber and the suction chamber for opening and closing the valve hole. By driving a solenoid so as to control the lift of the valve element from the valve hole, the flow rate of refrigerant is adjusted which flows from the discharge chamber side to the suction chamber side (see e.g. Japanese Laid-Open Patent Publication (Kokai) No. 2003-328936 (FIG. 2, etc.)).

More specifically, this control valve has the valve element disposed on the downstream side of the valve hole, and a shaft for axially supporting the valve element on a side of the valve element opposite from the valve hole. The shaft is integrally formed with a plunger (movable core) of the solenoid and is in contact with an end face of the valve element. The control valve includes a spring urging the valve element in the valve-opening direction, a spring interposed between the plunger and a core (fixed core), for urging the plunger in the valve-opening direction, and a spring for urging the plunger in the valve-closing direction. As a result, when the solenoid is energized, the valve element is held at a position where the pressure of refrigerant, the resultant force of the springs, and a solenoid force are balanced, whereby the valve opening degree of the control valve is determined.

In the control valve configured as above, if an urging force in the valve-closing direction becomes short as the valve element moves from its valve-closing position to an end position of a pressure control area over which pressure control is actually performed, the valve element suddenly moves to a fully-open position, in spite of the fact that the valve portion should be held at a predetermined valve opening degree. More specifically, if the force applied to the valve element in the valve-closing direction temporarily decreases in spite of the fact that the valve opening degree increases when the valve element is in the pressure control area, the valve element suddenly moves to the fully-open position when the force generated by the pressure of refrigerant in the valve-opening direction has exceeded a force as a starting point of the decrease. On the other hand, when the pressure of refrigerant is reduced by the fully-open state of the valve, the valve element moves to a fully-closed position again. The above motions of the valve element raise the problem that valve is repeatedly opened and closed, whereby it is impossible to realize stable pressure control in the pressure control area.

To solve this problem, conventionally, when the valve element is in the pressure control area, the urging forces of the springs are increased as the valve opening degree increases, whereby the force generated by the springs and the solenoid in the valve-closing direction and the force generated by the pressure of refrigerant in the valve-opening direction are balanced.

However, when the force generated by the springs in the valve-closing direction is increased as described above, this results in a decrease in the maximum valve opening degree. Therefore, it is impossible to ensure a sufficient flow rate of refrigerant when the valve is fully open, resulting in the degraded responsiveness in causing the compressor to shift to operation with the minimum displacement.

SUMMARY OF THE INVENTION

The present invention has been made in view of the problem, and an object thereof is to provide a control valve for a variable displacement compressor, which is capable of stably operating in a pressure control area, and causing the compressor to quickly shift to operation with the minimum displacement when a solenoid is not energized.

To solve the above problem, the present invention provides a control valve for a variable displacement compressor, for controlling refrigerant displacement in the compressor, comprising a valve element that is disposed in a manner movable to and away from a valve hole to open and close the valve hole, the valve hole forming a refrigerant passage via which a crankcase of the compressor is communicated for introduction and delivery of the refrigerant, a shaft that is axially supporting the valve element, a solenoid that imparts a solenoid force in a valve-closing direction to the valve element via the shaft, and urging means for generating an urging force against the solenoid force, a force generated in the valve-closing direction by a resultant force of the urging force and the solenoid force being set such that the force is constant or increases, as the valve element is lifted from its valve-closing position at least to a predetermined position past a pressure control area, and decreases, after the valve element moves beyond the predetermined position.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, an embodiment of the present invention will be described in detail with reference to the drawings. It should be noted that in the following description, for convenience sake, structures or parts in positional relationships with other structures or parts are sometimes described as "upper", "top", "above" or the like and "lower" "bottom", "below" or the like with reference to their positions as viewed in FIG. 1.

Figure 1:
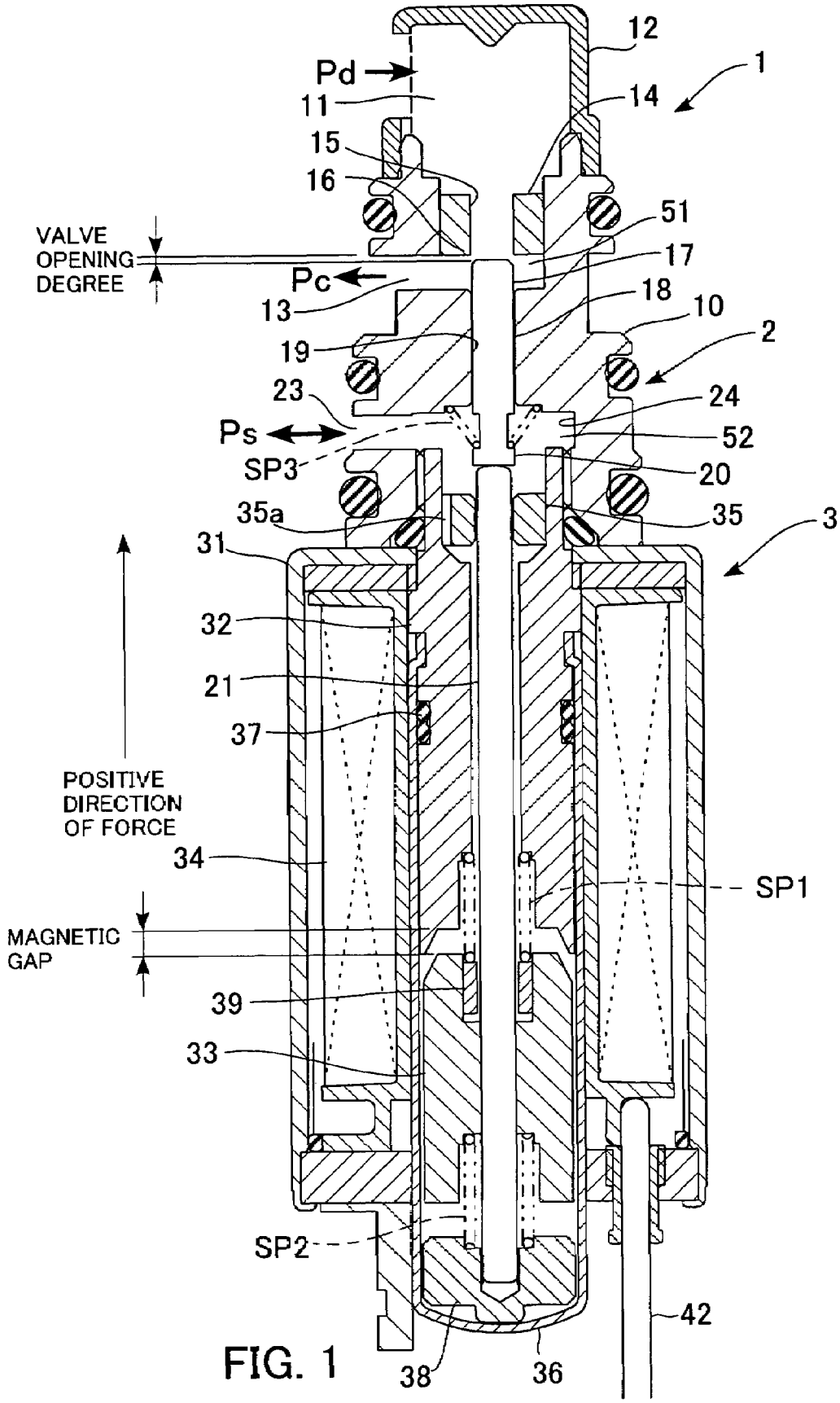
FIG. 1 is a cross-sectional view showing the construction of a control valve for a variable displacement compressor, according to an embodiment of the present invention.

FIG. 1 is a cross-sectional view showing the construction of a control valve for a variable displacement compressor, according to the present embodiment.

The control valve 1 for a variable displacement compressor (not shown) is formed by integrally assembling a valve section 2 that opens and closes a refrigerant passage for allowing part of refrigerant discharged from the compressor to flow into a crankcase thereof, and a solenoid 3 for controlling the flow rate of refrigerant passing through a valve portion of the valve section 2 by adjusting the amount of opening of the valve portion.

The valve section 2 includes a body 10 whose top is formed with a port 11 that communicates with a discharge chamber of the compressor for receiving discharge pressure Pd from the discharge chamber. The body 10 has a strainer 12 fitted on an upper end thereof in a manner covering the port 11. The port 11 communicates with a port 13 formed in a side portion of the body 10, via a refrigerant passage through the inside of the body 10. The port 13 communicates with the crankcase of the compressor so as to supply controlled pressure Pc in the crankcase (hereinafter referred to as "the crankcase pressure Pc").

A hollow cylindrical valve seat-forming member 14 is fitted in a refrigerant passage communicating between the port 11 and the port 13. A valve hole 15 is formed by an internal passage of the valve seat-forming member 14, and a valve seat 16 is formed by an inner periphery of an end of the valve seat-forming member 14 on the crankcase side.

Further, opposite to a side of the valve seat 16, from which the discharge pressure Pd is supplied, a valve element 17 is disposed in a manner movable to and away from the valve seat 16. The valve element 17 has a long cylindrical body having a guided portion 18 as a central part thereof. The guided portion 18 is slidably inserted in a guide hole 19 formed in the body 10. The valve element 17 has one end thereof disposed in a pressure chamber 51 communicating with the crankcase on the downstream side of the valve hole 15 such that the end of the valve element 17 is moved to and away from the valve hole 15 for opening and closing the same. Further, the valve element 17 has a flange 20 formed as a portion below the guided portion 18 of the valve element 17, with a small-diameter portion of the valve element 17 extending between the guided portion 18 and the flange 20, and the flange 20 is axially supported by a long shaft 21 disposed on the same axis as that of the valve element 17. The valve element 17 has approximately the same cross-sectional area as that of the valve hole 15 except for the small-diameter portion, and forms a so-called spool valve element an end of which is partially inserted into the valve hole 15 when the valve hole 15 is closed.

Further, a port 23 communicating with a suction chamber of the compressor for receiving suction pressure Ps is formed at a location slightly lower than the center of the body 10, and communicates with an open hole 24 with a predetermined depth, formed in the center of a lower portion of the body 10. The open hole 24 forms a pressure chamber 52 into which the suction pressure Ps is introduced, and within which abutment portions of the valve element 17 and the shaft 21 are disposed.

On the other hand, the solenoid 3 is comprised of a core 32 fixed within a casing 31 of the solenoid 3, a plunger 33 for moving the valve element 17 forward and backward via the shaft 21 so as to cause the valve section 2 to open and close, and a solenoid coil 34 for generating a magnetic circuit including the core 32 and the plunger 33 by electric current externally supplied thereto.

The core 32 has a threaded portion formed at an upper end thereof, and the threaded portion is screwed into a thread formed in the inner peripheral wall of the open hole 24 of the body 10, whereby the core 32 is rigidly fixed to the body 10. The core 32 has an insertion hole which axially extends through the center thereof for having an upper half of the shaft 21 inserted therein. A hollow cylindrical guide member 35 for slidably supporting an upper end of the shaft 21 is fitted in an opening at an upper end of the insertion hole. The guide member 35 has a refrigerant passage (groove) 35*a* axially formed in a periphery thereof along the entire length thereof.

The upper half of a bottomed sleeve 36 having a closed lower end is fitted on the lower half of the core 32. Within the bottomed sleeve 36, the plunger 33 is made integral with the shaft 21, and axially movably supported at a location below the core 32. The bottomed sleeve 36 has an upper end thereof fitted in a groove circumferentially formed in a central portion of the core 32. Further, a sealing member 37 having a shape of a gourd in cross-section is disposed between the bottomed sleeve 36 and the core 32, thereby holding hermetic the inside of the bottomed sleeve 36.

Further, a bearing member 38 is fixedly disposed within a lower end of the bottomed sleeve 36, and slidably supports a lower end of the shaft 21. The plunger 33 is fitted on a lower portion of the shaft 21 above the lower end thereof. A hollow cylindrical seat surface-forming member 39 is press-fitted in a hole opening in the center of an upper end face of the plunger 33. The plunger 33 is urged downward by a spring SP1 (first spring) interposed between the core 32 and the seat surface-forming member 39, and on the other hand is urged upward by a spring SP2 (second spring) interposed between the plunger 33 and the bearing member 38. The spring SP1 is configured such that a spring load which the spring SP1 imparts to the plunger 33 can be set by adjusting the amount of press-fitting insertion of the seat surface-forming member 39 into the hole of the plunger 33, whereby it is possible to set the valve opening degree of the valve portion and further the axial position of the spring SP1 in which the magnetic gap is increased to make the spring SP1 free (i.e. the spring SP1 have an approximately natural length thereof).

Further, interposed between a portion of the body 10 close to an opening at a lower end of the guide hole 19 of the body 10 and the flange 20 of the valve element 17 is a spring SP3 (third spring) having a conical shape, the outer diameter of which is expanded upward, for urging the valve element 17 in the valve-opening direction such that the valve element 17, the shaft 21, and the plunger 33 can move in unison.

Furthermore, the solenoid coil 34 is disposed along the outer periphery of the bottomed sleeve 36, and a harness 42 for supplying electric current to the solenoid coil 34 extends to the outside of the solenoid coil 34.

Figure 2:
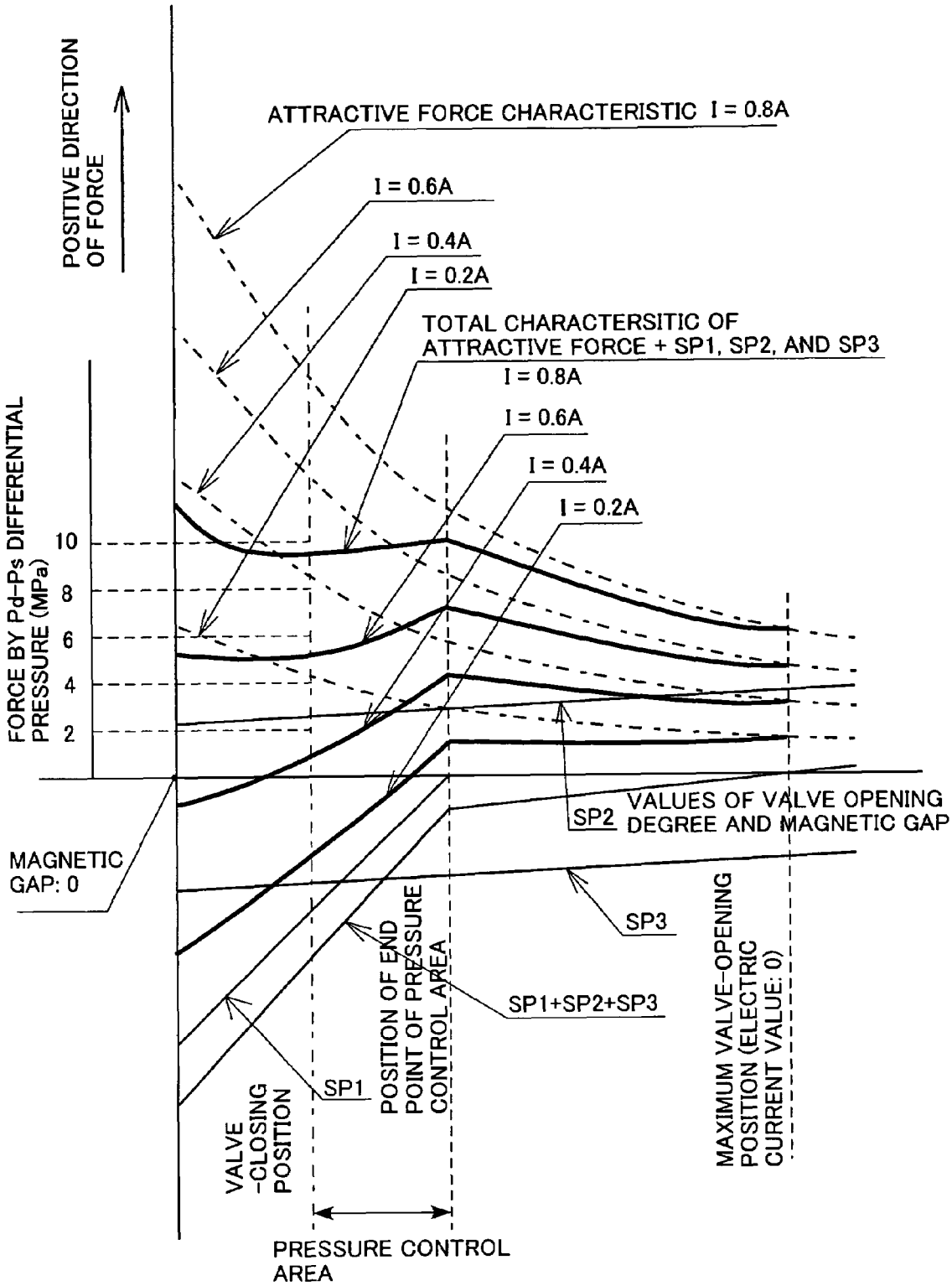
FIG. 2 is a graph showing the relationship between axial forces applied to a valve element.

Next, a description will be given of the characteristics of forces applied to the valve element of the control valve for the variable displacement compressor. FIG. 2 is a graph showing the relationship between axial forces applied to the valve element. In FIG. 2, the horizontal axis represents the magnitude of the magnetic gap formed between the plunger and the core (corresponding to the magnitude of the valve opening degree, i.e. the lift amount of the valve element 17) and the vertical axis represent the magnitude of each force applied to the valve element, provided that the valve-closing direction is positive. It should be noted that the magnetic gap and the positive direction of the force defined here are shown in FIG. 1.

As shown in FIG. 2, solenoid forces obtained during energization of the solenoid by changing electric current such that it assumes respective current values (I) of 0.2A, 0.4A, 0.6A, and 0.8A are indicated by one-dot chain lines as representing the attractive force characteristic of the solenoid 3. Further, the spring loads of the respective springs SP1, SP2, and SP3, and the resultant of the forces (SP1+SP2+SP3) are indicated by thin solid lines. The characteristic of a total force, which is a total sum of each of the solenoid forces associated with the respective electric current values and the resultant force of the spring loads, is indicated by a thick solid line.

As can be seen from FIG. 2, in the present embodiment, the spring SP1 and the spring SP3 cause forces in the valve-opening direction (i.e. negative forces) to act on the valve element 17, while the spring SP2 and the solenoid 3 cause forces in the valve-closing direction (i.e. positive forces) to act on the valve element 17. The spring SP1 is configured such that it has a larger spring constant than those of the springs SP2 and SP3, and the spring load thereof acts up to an end point of a pressure control area over which pressure control is actually performed. It should be noted that the term "pressure control area" here is intended to mean a area where the valve element 17 is axially displaced by the pressure control in a state in which the solenoid 3 is energized and the forces applied to the valve element 17 are balanced, (i.e. a range of lift position of the valve element 17 from the valve seat 16).

More specifically, the amount of press-fitting insertion of the seat surface-forming member 39 into the hole of the plunger 33 is adjusted such that the spring SP1 is made free when the valve element 17 is lifted to the end point of the pressure control area. Therefore, as the valve element 17 is lifted from the closed state to increase the magnetic gap, the compressed spring SP1 is progressively expanded by elasticity to thereby reduce the spring load thereof. Then, when the valve element 17 is displaced to the end point of the pressure control area, the spring SP1 comes to have an approximately natural length thereof to lose its elastic force. Therefore, the force of the spring SP1 acts on the valve element 17 as it moves from its valve-closing position to the end point of the pressure control area, and ceases to act thereafter. As a result, the resultant force (SP1+SP2+SP3) of the spring loads varies along a polygonal line in which the slope of the line indicative of the resultant force becomes gentle from the end point of the pressure control area.

Therefore, as shown in FIG. 2, the force in the valve-closing direction generated by the total force of the resultant force of the spring loads and each of the solenoid forces at the respective electric current values has characteristics that it increases as the valve element 17 is lifted from its valve-closing position to the end point of the pressure control area, and decreases as the valve element 17 moves beyond the end point. Accordingly, when the valve element 17 is located in the pressure control area, the total force of the resultant force of the spring loads and each of the solenoid forces increases with an increase in the valve-opening degree, and hence even when the force in the valve-opening direction by the differential pressure (Pd−Ps) between the discharge pressure Pd and the suction pressure Ps changes to some degree, the force in the valve-opening direction is balanced with the total force. This prevents the valve portion from being fully opened by a sudden displacement of the valve element 17 to its maximum valve-opening position when it is in the pressure control area in spite of the fact that the solenoid 3 is not deenergized.

On the other hand, when the valve-opening degree further increases to cause the valve element 17 to move beyond the end point of the pressure control area, the force in the valve-closing direction generated by the total force of the resultant force of the spring loads and each of the solenoid forces decreases, which relatively increases the force in the valve-opening direction to increase the valve-opening degree of the valve portion when it is fully open.

Referring again to FIG. 1, in the control valve 1 configured as above, the pressure-receiving area of the valve element 17 and the cross-sectional area of the valve hole 15 are equal to each other, and therefore the crankcase pressure Pc does not substantially act in the axial direction of the valve element 17. Therefore, the valve element 17 senses the differential pressure between the discharge pressure Pd and the suction pressure Ps to move in the opening or closing direction of the valve portion.

Further, the spring loads of the springs SP1 and SP3 for imparting urging forces in the valve-opening direction to the valve element 17 are set to be larger than the spring load of the springs SP2 for imparting an urging force in the valve-closing direction to the valve element 17. As a consequence, when the solenoid is not energized, the valve element 17 is away from the valve seat 16 to thereby hold the valve portion in the fully-open state. At this time, high-pressure refrigerant at the discharge pressure Pd, which has been introduced from the discharge chamber of the compressor to the port 11, passes through the fully-open valve portion, and flows from the port 13 into the crankcase. This makes the crankcase pressure Pc close to the discharge pressure Pd, whereby the compressor is caused to operate with the minimum displacement.

On the other hand, when an automotive air conditioner is started or when the cooling load is maximum, the value of electric current supplied to the solenoid 3 becomes maximum. At this time, the plunger 33 is attracted with the maximum attractive force by the core 32, so that the valve element 17 is pushed by the shaft 21 fixed to the plunger 33, in the valve-closing direction against the urging forces of the spring SP1 and the spring SP3, whereby the valve element 17 is seated on the valve seat 16 to fully close the valve portion. At this time, the high-pressure refrigerant at the discharge pressure Pd, introduced into the port 11 is blocked by the fully-closed valve portion, which makes the crankcase pressure Pc close to the suction pressure Ps, whereby the compressor is caused to operate with the maximum displacement.

Now, when the value of electric current supplied to the solenoid 3 is set to a predetermined value, the valve element 17 is stopped at a valve lift position where the force generated in the valve-opening direction by the differential pressure between the discharge pressure Pd and the suction pressure Ps and the spring loads of the spring SP1 and the spring SP3, and the force generated in the valve-closing direction by the spring load of the spring SP2 and the solenoid force are balanced.

In the above balanced state, when the rotational speed of the compressor is increased e.g. by an increase in the rotational speed of the engine, causing an increase in the displacement of the compressor, the discharge pressure Pd increases and the suction pressure Ps decreases so that the differential pressure (Pd−Ps) increases to cause a force in the valve-opening direction to act on the valve element 17, whereby the valve element 17 is further lifted, thereby allowing refrigerant to flow from the discharge chamber into the crankcase at an increased flow rate. As a result, the pressure Pc increases to cause the compressor to operate in a direction in which the displacement thereof is reduced, whereby the differential pressure (Pd−Ps) is controlled to a predetermined value set by the solenoid 3. At this time, even when the differential pressure (Pd−Ps) changes to some degree in the course of becoming equal to the predetermined value, since the force in the valve-closing direction is configured to increase when the valve element is in the pressure control area, the valve element 17 is not displaced to the fully open position, thereby realizing stable pressure control. On the other hand, when the rotational speed of the engine has decreased, the control valve operates oppositely to the above, whereby the compressor is controlled such that the differential pressure (Pd−Ps) becomes equal to the predetermined value set by the solenoid 3.

As described hereinabove, in the control valve, the force applied to the valve element 17 in the valve-closing direction increases when the valve element is in the pressure control area so as to be balanced with the force applied to the valve element 17 in the valve-opening direction by the pressure of refrigerant, thereby making it possible to realize stable pressure control.

Further, when the valve element 17 moves beyond the end point of the pressure control area, the force applied to the valve element 17 in the valve-closing direction decreases to thereby increase the valve opening degree when the valve portion is fully open. This makes it possible to ensure a sufficient flow rate of refrigerant when the solenoid 3 is not energized, thereby making it possible to cause the compressor to quickly shift to operation with the minimum displacement.

It should be noted that although in the present embodiment, the control valve for the variable displacement compressor is configured as a control valve which provides control such that the differential pressure between the discharge pressure Pd and the suction pressure Ps becomes constant to thereby change the flow rate of refrigerant introduced from the discharge chamber to the crankcase, by way of example, this is not limitative, but the control valve may be configured as a control valve which provides control such that the differential pressure between the crankcase pressure Pc and the suction pressure Ps becomes constant to thereby change the flow rate of refrigerant allowed to flow from the crankcase to the suction chamber.

Further, although in the present embodiment, the force generated in the valve-closing direction by the resultant force of the urging forces of the springs and the solenoid force is set such that it increases as the valve element 17 is lifted from its valve-closing position to the end point of the pressure control area, this is not limitative, but the area in which the force in the valve-closing direction increases may be set to a predetermined position beyond the end point of the pressure control area. Further, the force in the valve-closing direction may be set such that it does not increase but it becomes approximately constant.

Further, although in the present embodiment, the seat surface-forming member 39 is disposed toward the plunger 33, by way of example, but the seat surface-forming member 39 may be disposed toward the core 32, or at both locations toward the plunger 33 and the core 32.

Furthermore, although the valve element 17 is configured to have a cylindrical shape with approximately the same cross-sectional area over the whole length thereof, this is not limitative but the valve element 17 may be configured such that the cross-sectional area of an upper end thereof in the vicinity of the valve hole 15 is made larger such that the valve element 17 can be seated over the valve hole 15. Further, since the valve element 17 also functions as a piston rod, the valve element may be configured such that a piston rod is coaxially rigidly fixed to a valve element portion moved to and away from the valve hole 15. Further, although the lower end of the valve element 17 is formed as the axially shorter flange 20, by way of example, this is not limitative, but the valve element 17 may be formed to have a long lower end protruding downward.

Further, although in the present embodiment, urging means which influences the characteristics of forces applied to the valve element 17 is implemented by the springs SP1, SP2, and SP3, the urging means may be implemented by other elastic members.

According to the control valve for a variable displacement compressor, according to the present invention, the force applied to the valve element in the valve-closing direction is constant or increases when the valve element is in the pressure control area, whereby it is balanced with the force applied to the valve element by the pressure of refrigerant in the valve-opening direction. Therefore, it is possible to realize stable pressure control.

Further, when the valve element has moved beyond the predetermined position past the pressure control area, the force applied to the valve element in the valve-closing direction decreases to increase the valve opening degree when the valve is fully open. Therefore, it is possible to ensure a sufficient flow rate of refrigerant to thereby cause the compressor to quickly shift to operation with the minimum displacement, when the solenoid is not energized.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A control valve for a variable displacement compressor, for controlling discharging amount of refrigerant in the compressor, comprising:

a valve element that is disposed in a manner movable to and away from a valve hole to open and close the valve hole, the valve hole forming a refrigerant passage via which a crankcase of the compressor is communicated for introduction or delivery of the refrigerant;

a shaft that is axially supporting the valve element;

a solenoid that imparts a solenoid force in a valve-closing direction to the valve element via the shaft; and urging means for generating an urging force against the solenoid force, a force generated in the valve-closing direction by a resultant force of the urging force and the solenoid force being set such that the force is constant or increases, as the valve element is lifted from its valve-closing position at least to a predetermined position past a pressure control area, and decreases, after the valve element moves beyond the predetermined position.

2. The control valve according to claim 1, wherein a flow rate of the refrigerant introduced from a discharge chamber to the crankcase is controlled such that differential pressure between discharge pressure in the discharge chamber and suction pressure in a suction chamber is held at a predetermined value, and wherein the valve hole forms a refrigerant passage via which the discharge chamber and the crankcase are communicated with each other, the valve element being disposed in a manner movable to and away from the valve hole from a crankcase side.

3. The control valve according to claim 1, wherein the solenoid includes a core that has the shaft axially inserted therein, and a plunger that is disposed on a side of the core opposite from the valve element such that the plunger moves in unison with the shaft for transmitting a driving force in the valve-closing direction to the valve element, and wherein the urging means includes at least a first spring interposed between the core and the plunger, for urging the plunger in a valve-opening direction, and a second spring disposed on a side of the plunger opposite from the core, for urging the plunger in the valve-closing direction, and wherein the first spring exerts an urging force thereof on the plunger as the valve element is lifted from its valve-closing position to the predetermined position, and is made free after the valve element moves beyond the predetermined position.

4. The control valve according to claim 3, wherein a seat surface-forming member whose axial position can be adjusted is disposed in at least one of the core and the plunger in a manner opposed to the first spring, and wherein a position where the first spring is made free can be set by adjusting the axial position of the seat surface-forming member.

5. The control valve according to claim 4, wherein the seat surface-forming member is press-fitted in a hole formed in an end face of the plunger such that the position where the first spring is made free can be set by adjusting an amount of press-fitting insertion into the plunger.

6. The control valve according to claim 4, wherein the urging means further includes a third spring for urging the valve element in the valve-opening direction, and wherein the valve element is lifted to a position of a maximum valve-opening position set in advance, by a resultant force of the second spring and the third spring, after the solenoid is deenergized and the first spring is made free.

* * * * *